US008784979B2

(12) United States Patent
Verlotski

(10) Patent No.: US 8,784,979 B2
(45) Date of Patent: Jul. 22, 2014

(54) THERMALLY SPRAYED GASTIGHT PROTECTIVE LAYER FOR METAL SUBSTRATES

(75) Inventor: Vadim Verlotski, Wuppertal (DE)

(73) Assignee: Märkisches Werk GmbH, Halver (DE)

( * ) Notice: Subject to any disclaimer, the term of this patent is extended or adjusted under 35 U.S.C. 154(b) by 707 days.

(21) Appl. No.: 12/129,872

(22) Filed: May 30, 2008

(65) Prior Publication Data

US 2008/0317966 A1 Dec. 25, 2008

(30) Foreign Application Priority Data

Jun. 19, 2007 (DE) ..... 10 2007 028 109

(51) Int. Cl.

| | |
|---|---|
| ***B05D 1/10*** | (2006.01) |
| ***B05D 1/00*** | (2006.01) |
| ***B32B 5/00*** | (2006.01) |
| ***H01L 21/316*** | (2006.01) |

(52) U.S. Cl.

USPC ..... 428/220; 416/241 R; 416/241 B; 106/287.18; 106/600; 428/450; 428/469; 428/633; 428/448; 428/632; 501/128; 501/133

(58) Field of Classification Search

None

See application file for complete search history.

(56) References Cited

U.S. PATENT DOCUMENTS

| | | | | |
|---|---|---|---|---|
| 3,625,773 | A * | 12/1971 | Charles et al. | 264/618 |
| 4,321,310 | A | 3/1982 | Ulion et al. | |
| 4,321,311 | A | 3/1982 | Strangman | |
| 4,377,371 | A | 3/1983 | Wisander et al. | |
| 4,401,697 | A | 8/1983 | Strangman | |
| 4,405,659 | A | 9/1983 | Strangman | |
| 4,873,209 | A * | 10/1989 | Gnyra | 501/95.1 |
| 5,033,721 | A * | 7/1991 | Gnyra | 266/280 |
| 5,169,689 | A | 12/1992 | Thompson et al. | |
| 5,989,330 | A * | 11/1999 | Semler et al. | 106/286.1 |
| 6,069,105 | A * | 5/2000 | Yamamoto et al. | 501/153 |
| 6,753,299 | B2 * | 6/2004 | Lunghofer et al. | 507/269 |
| 6,773,618 | B2 * | 8/2004 | Eyhorn et al. | 252/62 |
| 2003/0165638 | A1 * | 9/2003 | Louks et al. | 427/600 |
| 2004/0148966 | A1 * | 8/2004 | Celikkaya et al. | 65/17.4 |
| 2004/0247923 | A1 * | 12/2004 | Hajmrle et al. | 428/545 |
| 2005/0056055 | A1 * | 3/2005 | Celikkaya et al. | 65/17.4 |
| 2006/0065072 | A1 * | 3/2006 | Ozaki et al. | 75/231 |
| 2007/0238603 | A1 * | 10/2007 | Kabashima et al. | 501/128 |

FOREIGN PATENT DOCUMENTS

| | | |
|---|---|---|
| DE | 3935222 | 4/1991 |
| DE | 19852285 | 4/2000 |
| EP | 1141437 | 10/2001 |
| GB | 2100261 | 12/1982 |
| WO | 9105888 | 5/1991 |
| WO | 92/00598 | 1/1992 |

OTHER PUBLICATIONS

Dietrich et al. Mat-wiss. u. Wekstofftech. 32, 2001, 669-672.*

Dietrich et al. Ceramic Eng. and Science proceedings, 2002, vol. 23, N.4, 449-456.*

Handbook of Chemistry and Physics, 1970-1971, Edited by Weast, p. B-139.*

Quartz data information from Wikipedia.com: http://en.wikipedia.org/wiki/Quartz (No Date).*

Albite Mineral Data from http://webmineral.com/data/Albite.shtml (No Date).*

Illite Mineral Data from http://webmineral.com/data/Illite.shtml (No Date).*

Anorthite Mineral Data from http://webmineral.com/data/Anorthite.shtml (No Date).*

Quartz Mineral Data from http://webmineral.com/data/Quartz.shtml (No Date).*

* cited by examiner

*Primary Examiner* — Vera Katz

(74) *Attorney, Agent, or Firm* — Katten Muchin Rosenman LLP

(57) ABSTRACT

In a thermally sprayed, gastight protective layer for metal substrates, such as Fe, Ni, Al, Mg and/or Ti, the spray powder for the purpose includes at least two components. The first is a silicate mineral or rock and the second is a metal powder and/or a further silicate mineral or rock. The silicate mineral or rock component in the spray powder has an alkali content of less than 6 percent by weight.

11 Claims, No Drawings

THERMALLY SPRAYED GASTIGHT PROTECTIVE LAYER FOR METAL SUBSTRATES

BACKGROUND OF THE INVENTION

1. Field of the Invention

The invention relates to protective layers for metals or metal alloys that can be used at high temperatures and in aggressive gaseous, liquid and solid media. Stated more precisely, the present invention relates to a thermally sprayed gastight protective layer for metal substrates, especially those based on Fe, Ni, Al, Mg and/or Ti, wherein the spray powder for the purpose comprises at least two components, of which the first is a silicate mineral or rock and the second is a metal powder and/or a further silicate mineral or rock.

2. Description of the Related Art

Enamels are known as nonmetallic protective layers for various metals and alloys (see [1]: A. Petzold, H. Pöschmann, Enamel and Enameling Technology, Wiley-VCH; Edition 2 (1992)). These protective layers have good adhesion to the substrate and protect the metal base materials reliably against many aggressive media up to approximately 400° C. In industry, silicate glasses having a relatively low $SiO_2$ content and a high alkaline oxide content are used as enamels for steels and cast iron (see [1]). Typical enamels for white enameling of steel sheet comprise a base and a cover enamel and have the following compositions:

| Base enamel Substance | Content (%) | Cover enamel Substance | Content (%) |
|---|---|---|---|
| $SiO_2$ | 47-53 | $SiO_2$ | 56 |
| $Al_2O_3$ | 4-6 | $Al_2O_3$ | 7 |
| $B_2O_3$ | 17-19 | $B_2O_3$ | 7 |
| $Na_2O + K_2O$ | 15-18 | $Na_2O + K_2O$ | 22.5 |
| $TiO_2$ | 2-8 | CaO | 7 |
| CaO + MgO | Remainder | F | 0.5 |

Special enamels for aluminum, copper alloys, stainless steels, titanium and other metals usually have even less $SiO_2$ and more alkalis than do enamels for steel and cast iron.

A high alkali content influences the corrosion resistance of the silicate enamels to water and acids negatively, but is absolutely necessary for the enameling process: firstly to keep the melting temperature low and secondly to achieve a high coefficient of thermal expansion—adapted to the respective substrate. Because of the enameling method, enamels for steels must have a melting point (liquidus temperature TL) below 850° C., while that of enamels for aluminum must even be below 550° C. (see [1]). Low melting temperatures and high necessary coefficients of thermal expansion make it impossible to use enamels of known acid-resistant glasses, such as silica glass, borosilicate glasses, E-glass, acid-proof porcelain glazes and others.

Also known are ceramic layers of high-melting, corrosion-resistant materials, which are applied on metal substrates by means of thermal spraying (flame spraying, high-velocity oxygen-fuel flame spraying (HVOF), plasma spraying) or PVD and CVD methods. For example, yttrium-stabilized zirconium oxide (YSZ) can be applied by thermal spraying [UK 2100621 A; U.S. Pat. No. 4,377,371; WO 91/05888; U.S. Pat. No. 5,169,689] and also by PVD [U.S. Pat. No. 4,321,310; U.S. Pat. No. 4,321,311; U.S. Pat. No. 4,401,697; U.S. Pat. No. 4,405,659; WO 92/0598] on substrates of steel and of nickel-base alloys. In YSZ layers, any difference between the coefficients of thermal expansion of layer and substrate is compensated by a porous structure having a network of fissures. Because of this property, such layers are resistant to thermal shock. However, they do not guarantee protection against oxidation and corrosion and can be used merely as pure thermal insulation layers at temperatures up to 1200° C. A second important disadvantage of YSZ layers lies in weak adhesion to the substrate. Together with low mechanical strength (because of fissures and pores), this means poor erosion resistance.

Other known ceramic layers such as TiN, TiC, CrC, CrN, DLC, etc., which are formed by PVD/CVD methods, have low coefficients of thermal expansion and therefore cannot be used at high temperatures; in particular, the layer becomes detached when the temperature is raised, because a metal substrate expands much more than the layer. For this reason, these very thin layers with layer thicknesses of less than 5 μm are used mainly for wear and corrosion protection at room temperature.

Further protective layers employed as thermal insulation for high-temperature applications are known from DE 19852285 C1 and EP 1141437 B1. In contrast to YSZ, these glass-metal/ceramic layers are free of pores and fissures, and so are gastight. The adhesion to the metal substrate is also substantially better than in the case of YSZ layers, because the metal surface is wetted by the glass component of the layer. The cited layers of the class in question are also resistant to thermal shock, because the coefficients of thermal expansion of the layer, of a metal intermediate layer that may be present and of the substrate are approximately equal or are matched to one another. A metal content improves the mechanical properties of the layer. Matching of the coefficients of thermal expansion is possible by variation of the glass composition and/or of the metal-glass or ceramic/glass ratio.

These glass-metal/ceramic layers are used as thermal insulation layers for turbine blades. An advantage compared with YSZ layers lies in oxidation protection for the substrate by the gastight layer microstructure. Nevertheless, these layers are not suitable as corrosion-protection layers. For the glass-metal/ceramic layers according to the prior art, it has been necessary to choose alkali-containing glasses, in order to achieve the highest possible coefficient of thermal expansion in order to match that of the substrate. For use as thermal insulation layers, this is also not critical.

In contrast, it is the object of the present invention to provide a thermally sprayed and gastight protective layer of the class in question for metal substrates, especially those based on Fe, Ni, Al, Mg and/or Ti, as well as a method for production of the same, wherein the layer offers corrosion protection for the substrate, even at high temperatures.

SUMMARY OF THE INVENTION

The present invention relates to thermally sprayed protective layers of the type mentioned hereinabove, which layers have been developed especially as corrosion protection against extremely aggressive media at normal and especially at high temperatures and which are characterized in that the silicate mineral or rock component in the spray powder has an alkali content of less than 6 percent by weight. By alkali content there will be understood the proportion by weight of oxides or alkali metals and also of alkali metals as such.

These layers offer protection for metal base materials against all aqueous salt solutions and acids (except for HF) in a low-temperature range and against many corrosive ashes, molten salts and corrosive gases in a high-temperature range.

Since the layers have low thermal conductivity and can be applied in large layer thicknesses, they can also be used for thermal insulation.

In contrast to the glass-metal/ceramic layers mentioned hereinabove, conventional silicate glasses are not used for the spray powder of the inventive protective layers. Instead, there are chosen mixtures of particularly corrosion-resistant, low-alkali, natural or synthetic minerals and rocks, which vitrify during spraying and immediately become partly devitrified or in other words crystallized in the resulting layer.

The inventive production method involves application of the protective layer on the metal substrate by means of flame spraying, high-velocity oxygen-fuel flame spraying (HVOF) or plasma spraying, and is characterized in that the coefficients of thermal expansion of layer and substrate are adapted during application of the protective layer by controlled partial devitrification of the mineral components of the spray powder.

In this way the coefficient of thermal expansion of the layer is adjusted by the new crystalline phases growing in the layer such that it is adapted to the substrate. Because of the selective crystallization of the silicate components, a broad range of coefficients of thermal expansion can be obtained, even without having to tolerate a high alkali content in the at least one silicate component. Thus controlled crystallization no longer depends merely on suitable choice of the mineral materials; to the contrary, their particle-size distribution in particular is also of decisive importance. This is so because the temperatures of the particles in the flame or in the plasma are strongly influenced by variation of the particle size, as is therefore the crystallization behavior in the resulting layer, ultimately permitting adaptation of the coefficients of thermal expansion.

DETAILED DESCRIPTION OF THE INVENTION

The protective layers of the present invention have all the advantages of the already known glass-metal/ceramic layers, because the mineral or rock component exists as glass during buildup of the layer. This glass contributes to good wetting of the substrate and of the metal particles and thus to good adhesion on the substrate. Moreover, it can be plastically deformed and it forms a perfect pore-free mixture with any metal component that may be present.

The partial crystallization takes place in the layer while it is still plastic, in such a way that no mechanical stresses develop in the protective layer. The decisive advantage of the inventive protective layer and of the inventive method compared with glass-metal/ceramic layers and enamels is that it is also possible in the present invention to use low-alkali and thus corrosion-resistant silicates, which in the already known prior art are unusable for coating of metals because of low coefficients of thermal expansion and high melting temperatures.

In principle, all possible metals and metal alloys are candidates for the metal component in the spray powder for the protective layer. Preferably, however, a metal powder comprising a nickel-base or copper-base alloy will be used.

The spray powder is advantageously composed of a total of three components, namely of a first and a second silicate mineral or rock and of a metal powder. With suitable particle sizes of the three components of the spray powder, and by suitable choice of their respective proportions by weight, the vitrification and partial devitrification of the spray powder can be controlled to achieve a protective layer that is optically adapted to the respective substrate.

The spray powder preferably contains a content of at least 10 per cent by weight of a silicate component having high purity with respect to silicon dioxide, which advantageously exceeds a content of 99% in the component.

Inventive protective layers can advantageously have a thermal conductivity of between 0.8 and 5 W/mK, which is also suitable for thermal insulation purposes, and can be applied in a layer thickness of 100 to 2500 μm. Layer thickness of greater than 2 mm prove to be particularly advantageous for an inventive protective layer, especially if their thermal insulation property is also needed.

In other respects, the present invention relates not only to an inventive protective layer but also to an at least two-component spray powder for production of same. The invention also relates to the use of the protective layer for protection of substrates such as parts of the combustion chambers of an internal combustion engine or of a gas turbine from high temperatures, corrosion and erosion. In the case of an internal combustion engine, these are in particular valves, pistons and cylinder heads; in gas turbines this relates in particular to the blades and plates. However, the inventive protective layer is also outstandingly suitable for protecting other machine parts used as substrates effectively against temperature, corrosion and erosion, such as parts of steam turbines, chemical plants, heat exchangers, etc.

The invention will be explained in more detail hereinafter on the basis of examples.

Example 1

The substrate is composed of a steel or of a nickel-base alloy. An inventive mineral-metal spray powder is sprayed thereon by flame spraying, plasma spraying or HVOF. Spraying takes place on a sandblasted substrate that has not been preheated, without remelting. The spray powder, with a grain size of <50 μm, is produced by spray drying and subsequent sintering (850° C., shield gas) from the following components:

- 65 wt % metal powder of gas-atomized 80Ni20Cr alloy (nickel chromium), particle size <25 μm;
- 25 wt % fused and finely ground synthetic black basalt, wt %: $SiO_2$ 50, CaO 20, $Al_2O_3$ 15, MgO 8, $Fe_2O_3$ 7, particle size <10 μm; alkali content <0.5 wt %
- 10 wt % ground and sieved natural quartz or cristobalite (particle size 25-50 μm) having a purity of >99% $SiO_2$.

The mineral-metal layer formed from this spray powder is free of pores and fissures and has a coefficient of thermal expansion of approximately $12\times10^{-6}$ $K^{-1}$ at 20° C. The thermal conductivity at 700° C. approximately 3 W/mK. The layer thickness can be varied in the range of 100 to 2500 μm. The maximum operating temperature in air is 1200° C. The coating is suitable as corrosion protection and thermal insulation for various parts of steels and nickel-base alloys subjected to high temperatures and thermal shock.

Example 2

The substrate is composed of a steel, of cast iron or of a nickel-base alloy. An inventive two-component mineral spray powder is sprayed thereon by flame spraying. Spraying takes place on a sandblasted substrate that has been preheated to approximately 500° C., with remelting at approximately 1100° C. The spray powder, with a grain size of <100 μm, is produced by mixing the following mineral components together:

- 67 wt % fused, ground and sieved (grain size 25 to 50 μm) synthetic white basalt, wt %: $SiO_2$ 54, CaO 20, MgO 5, $Al_2O_3$ 16, $Na_2O$ 5; alkali content ≤0.5 wt %

33 wt % ground and sieved (particle size 25-100 μm) cristobalite having a purity of >99% $SiO_2$.

In addition, 1 to 6 wt % of the following oxides can be admixed with the spray powder to impart color to the layer: CoO, $Cr_2O_3$, $TiO_2$, $ZrO_2$, ZnO and $Fe_2O_3$.

A mineral layer formed from this spray powder has low pore content (<3%), is free of fissures and has a coefficient of thermal expansion of approximately $11\times10^{-6}$ $K^{-1}$ at 20° C. The thermal conductivity of the layer at 700° C. is approximately 1 W/mK. The layer thickness can be varied in the range of 100 to 600 μm. The maximum operating temperature in air is approximately 1000° C. Since the coating does not contain any metal components, it is less susceptible to thermal shock than metal-containing mineral-metal layers. The preferred area of application of the layer is therefore corrosion protection, especially against acids, for parts exposed to moderate thermal shock.

Example 3

The substrate is composed of an aluminum or magnesium alloy. A mineral-metal spray powder is sprayed thereon by plasma spraying or HVOF. Spraying takes place on a sandblasted substrate that has not been preheated, without remelting. The spray powder, with a grain size of <50 μm, is produced by spray drying and subsequent sintering (620° C., shield gas) from the following components:

62 wt % metal powder of gas-atomized 90Cu10Sn alloy (tin bronze), particle size <25 μm;

18 wt % finely ground (particle size <10 μm) natural black basalt (basalt flour), alkali content <5 wt %

20 wt % ground and sieved (particle size 25-50 μm) natural quartz or cristobalite having a purity of >99% $SiO_2$.

The mineral-metal layer formed from this spray powder is free of pores and fissures and has a coefficient of thermal expansion of approximately $18\times10^{-6}$ $K^{-1}$ at 20° C. The thermal conductivity of the layer at 400° C. is approximately 5 W/mK. The layer thickness can be varied in the range of 100 to 2500 μm. The maximum operating temperature of the protective layer in air is approximately 700° C.—not considering the substrate. The coating is suitable as corrosion protection for various parts of aluminum and magnesium alloys subjected to intense thermal shock.

Example 4

The substrate is composed of a titanium alloy. A mineral-metal spray powder is sprayed thereon by plasma spraying or HVOF. Spraying takes place on a sandblasted substrate that has not been preheated, without remelting. The spray powder, with a grain size of <50 μm, is produced by spray drying and subsequent sintering (800° C., shield gas) from the following components:

57 wt % metal powder of gas-atomized 80Ni20Cr alloy (nickel chromium), particle size <25 μm;

31 wt % finely ground (particle size <10 μm) natural black basalt (basalt flour)

12 wt % ground and sieved (particle size 25-50 μm) natural spodumen having a purity of >95% LiAlSi2O6.

A mineral-metal layer formed from this spray powder is free of pores and fissures and has a coefficient of thermal expansion of approximately $7.5\times10^{-6}$ $K^{-1}$ at 20° C. The alkali content (including Li) of the mineral components is also <5 wt % here. The thermal conductivity of the layer at 700° C. is approximately 2 W/mK. The layer thickness can be varied in the range of 100 to 2500 μm. The maximum operating temperature in air is 900° C. The coating is suitable as high-temperature corrosion protection and thermal insulation for various parts of titanium alloys subjected to intense thermal shock.

The invention claimed is:

1. A thermally sprayed, gastight protective layer for a metal substrate; the substrate selected from one of Fe, Ni, Al, Mg or Ti, the protective layer comprising:

a first and a second component, the first component comprising a first silicate, the second component comprising one of a first metal powder, a second silicate, and a combination of the first metal powder and the second silicate;

wherein an alkali content of a combination of the first and second components in an initial spray powder is less than 6 percent by weight; and wherein the first and the second silicate are selected from a silicate mineral or a silicate rock.

2. A protective layer according to claim 1, wherein the first metal powder comprises a nickel-base or copper-base alloy.

3. A protective layer according to claim 1, wherein the first silicate or the second silicate comprise a natural or synthetically produced mineral or rock.

4. A protective layer according to claim 1, wherein the second component is the combination of the first metal powder and the second silicate.

5. A protective layer according to claim 1, wherein the protective layer comprises at least 10 percent by weight of the first silicate, second silicate or a combination of first and second silicates, wherein the purity of the first silicate or combination of first and second silicates in terms of $SiO_2$ content is greater than 99 percent.

6. A protective layer according to claim 1, wherein the protective layer has a thermal conductivity of between 0.8 and 5 W/mK.

7. A protective layer according to claim 1, wherein the protective layer has a layer thickness of 100 to 2500 μm.

8. A protective layer according to claim 1, wherein the protective layer has a layer thickness of greater than 2 mm.

9. A spray powder for producing a protective layer, the spray powder comprising:

a first and a second component, the first component comprising a first silicate, the second component comprising one of a first metal powder, a second silicate, and a combination of the first metal powder and the second silicate;

wherein an alkali content of a combination of the first and second components is less than 6 percent by weight; and wherein the first and the second silicate are selected from a silicate mineral or a silicate rock;

wherein when sprayed a protective layer results over a substrate.

10. A method of applying a protective layer, the protective layer comprising a first and a second component, the first component comprising a first silicate, the second component comprising one of a first metal powder, a second silicate, and a combination of the first metal powder and the second silicate;

wherein an alkali content of a combination of the first and second components in an initial spray powder is less than 6 percent by weight; and wherein the first and the second silicate are selected from a silicate mineral or a silicate rock;

the method comprising the step of:

(a) applying the protective layer to a substrate to protect against high temperature, corrosion or erosion, the substrate comprising a surface of a combustion engine or a gas turbine.

11. The method of claim 10, wherein the first silicate or the second silicate comprise a natural or synthetically produced mineral or rock.

* * * * *